US005324024A

United States Patent [19]

Mori

[11] Patent Number: 5,324,024

[45] Date of Patent: Jun. 28, 1994

[54] PAPER DISCHARGING APPARATUS

[75] Inventor: Tomiya Mori, Shibata, Japan

[73] Assignee: Ricoh Company, Ltd., Tokyo, Japan

[21] Appl. No.: 872,768

[22] Filed: Apr. 23, 1992

[30] Foreign Application Priority Data

| | | | |
|---|---|---|---|
| Apr. 24, 1991 | [JP] | Japan | 3-094387 |
| Aug. 19, 1991 | [JP] | Japan | 3-206886 |
| Oct. 31, 1991 | [JP] | Japan | 3-286012 |

[51] Int. Cl.[5] ..... B65H 39/10

[52] U.S. Cl. ..... 271/296; 271/211

[58] Field of Search ..... 271/189, 211, 287, 296, 271/309

[56] References Cited

U.S. PATENT DOCUMENTS

| | | | |
|---|---|---|---|
| 4,036,087 | 7/1977 | Braun | 271/211 X |
| 4,095,781 | 6/1978 | Kistner et al. | 271/98 X |
| 4,317,563 | 3/1982 | Zimmerman et al. | 271/211 |
| 4,418,905 | 12/1983 | Garavuso | 271/98 |
| 4,561,645 | 12/1985 | Pollich | 271/195 |
| 4,702,468 | 10/1987 | Pollich | 271/211 X |
| 4,799,847 | 1/1989 | Bodeweir | 271/211 X |
| 4,811,547 | 3/1989 | Raats et al. | 271/211 X |
| 4,815,721 | 3/1989 | Morgan | 271/211 X |

FOREIGN PATENT DOCUMENTS

| | | | |
|---|---|---|---|
| 2455937 | 8/1976 | Fed. Rep. of Germany | 271/211 |
| 2548788 | 12/1977 | Fed. Rep. of Germany | 271/211 |
| 1301610 | 7/1962 | France | 271/211 |
| 0171764 | 7/1988 | Japan | 271/211 |
| 0003860 | 1/1991 | Japan | 271/211 |
| 51446 | 9/1932 | Norway | 271/211 |
| 185265 | 9/1966 | U.S.S.R. | 271/211 |
| 602447 | 5/1948 | United Kingdom . | |
| 1018965 | 2/1966 | United Kingdom . | |

*Primary Examiner*—H. Grant Skaggs
*Assistant Examiner*—Carol Lynn Druzbick
*Attorney, Agent, or Firm*—Oblon, Spivak, McClelland, Maier & Neustadt

[57] ABSTRACT

A paper discharging apparatus sequentially discharges a sheet of paper having an image on a surface thereof and stacks the paper sheet on a paper discharging base. The paper discharging apparatus has a blower for sending a gas flow to a space between a surface of the paper sheet previously discharged and arranged on the paper discharging base and a rear face of the next discharged paper sheet. A paper discharging apparatus of a printer has a paper discharging section having a paper discharging base for stacking a sheet of paper having a printed image on a surface thereof, and a paper feeding section for feeding the paper sheet to this paper discharging section. The paper feeding section has a blowing member for sending a gas to a space between a surface of the paper sheet previously fed and a rear face of the next fed paper sheet. The paper discharging section has a restraining member for restraining the gas supplied by the blowing member from being leaked on a side of the paper sheet. Another paper discharging apparatus is also shown.

16 Claims, 13 Drawing Sheets

PAPER DISCHARGING APPARATUS

BACKGROUND OF THE INVENTION

1. Field of the Invention

The present invention relates to a paper discharging apparatus for sequentially discharging a sheet of paper having an image thereon onto a paper discharging base of a printer, etc. and a paper discharging tray of an on-line sorter for receiving and sorting a sheet of sheet discharged from the printer, etc. on line. The present invention also relates to a paper discharging apparatus used in a rotary stencil duplicator.

2. Description of the Related Art

As is well known, in a printer and an on-line sorter, a sheet of paper having a printed image thereon is sequentially discharged and stacked on a paper discharging base or tray by a paper-discharging conveying means within the printer.

The general printer and the general on-line sorter are constructed such that the paper-discharging conveying means approximately discharges the sheet of paper in a horizontal direction. Therefore, a front end of the paper sheet discharged by the paper-discharging conveying means hangs down by its empty weight.

Accordingly, in the printer or the on-line sorter mentioned above, the discharged paper sheet is moved in a paper discharging direction while the front end of the discharged paper sheet comes in frictional contact with a printed image face of the paper sheet previously discharged and stacked on the paper discharging base. Therefore, a printed image of the paper sheet previously discharged and stacked on the paper discharging base is damaged by this front end of the discharged paper sheet. Further, the front end of the discharged paper sheet is dirtied by this printed image.

To solve such problems, in a proposed paper discharging apparatus, the discharged paper sheet is curved in an arc shape in cross section in a direction perpendicular to the paper discharging direction. Thus, a bending strength of the paper sheet as an apparent rigidity in the paper discharging direction is increased to prevent the front end of the paper sheet from hanging down when the paper sheet is discharged.

For example, Japanese Patent Application Laying Open (KOKAI) No. 56-61266 shows a device for discharging and guiding a sheet of paper. In this device, a pair of guide members are disposed on opposite sides. A distance between the guide members is increased from a paper discharging port along a paper discharging direction. The guide members have edge portions inclined upwards. The guide members extend from the paper discharging port in the paper discharging direction. A sheet of paper passes through a space between these guide members such that the paper sheet is moved from a lower side to an upper side. Thus, the paper sheet is curved in an arc shape in cross section in a direction. Accordingly, an apparent rigidity of the paper sheet is increased in the paper discharging direction to prevent a front end of the paper sheet from hanging down when the paper sheet is discharged.

In this paper-discharging guiding device shown in Japanese Patent Application Laying Open (KOKAI) No. 56-61266, the pair of guide members extend from the paper discharging port in the paper discharging direction. Accordingly, a curving state of the paper sheet can be maintained for a long time. However, since the guide members extend to an upper portion of a paper discharging tray, it is not easy to take out paper sheets discharged and stacked on the paper discharging tray. Further, there is a fear that the discharged paper sheets and the guide members are damaged. Furthermore, when a paper sheet having a stronger bending strength is discharged, there is a case in which the paper sheet does not drop as expected and is caught by the guide members therebetween and is moved and stopped on the guide members, thereby tending to cause a discharged paper jam.

To solve the above problems, there is a method for increasing a difference in distance between the paper discharging port and a stacking face of the paper sheet in a paper discharging section. In this method, a paper discharging space of the paper discharging base is increased in a vertical direction such that no front end of the discharged paper sheet comes in contact with a surface of the paper sheet previously discharged and stacked on the paper discharging base. However, in this method, it is necessary to separately dispose a paper discharging space above the paper discharging base in addition to a space for stacking paper sheets. Accordingly, for example, when this method is applied to a paper discharging apparatus of an on-line sorter having many paper discharging trays, the entire apparatus is very large-sized since respective distances between the paper discharging trays are increased.

Further, an air layer flows out of the paper sheet at both side edges thereof as the paper sheet is moved forward in the paper feeding direction. Accordingly, an air pressure is reduced so that no upper and lower paper sheets can be separated from each other. As a result, problems similar to those in the general paper discharging apparatus are caused. Therefore, these problems cannot be effectively solved by the general paper discharging apparatus.

SUMMARY OF THE INVENTION

It is therefore a first object of the present invention to provide a paper discharging apparatus in which a sheet of paper can be reliably guided to a small paper discharging space on a paper discharging base or tray and paper sheets can be regularly stacked on the paper discharging base or tray without damaging and dirtying a printed image face of the paper sheet previously stacked on the paper discharging base or tray.

A second object of the present invention is to provide a paper discharging apparatus in which no image formed on the surface of a sheet previously discharged is usually dirtied by a frictional contact between the previous and present sheets and no discharged paper jam is usually caused and the paper sheets are regularly discharged and arranged.

A third object of the present invention is to provide a paper discharging apparatus in which a printed image face of a sheet of paper previously fed and a front end of the moving present sheet are not dirtied and it is possible to prevent the paper sheet from dropping in a position different from a predetermined position by a frictional contact between the paper sheets so that discharged paper sheets are not scattered as a whole and are reliably stacked in a small space and the entire discharging apparatus is made compact and no large space for arranging the discharging apparatus is required.

The above first object of the present invention can be achieved by a paper discharging apparatus for sequentially discharging a sheet of paper having an image on a surface thereof and stacking the paper sheet on a paper discharging base; the paper discharging apparatus comprising blowing means for sending a gas flow to a space between a surface of the paper sheet previously discharged and arranged on the paper discharging base and a rear face of the next discharged paper sheet.

The above first object of the present invention can be also achieved by a paper discharging apparatus for sequentially discharging a sheet of paper having an image on a surface thereof and stacking the paper sheet on a plurality of paper discharging trays; the paper discharging apparatus comprising blowing means for sending a gas flow to a space between a surface of the paper sheet previously discharged and arranged on the paper discharging trays and a rear face of the next discharged paper sheet.

In this structure, a gas flow is emitted by the blowing means to a space between a surface of the paper sheet previously discharged and arranged on the paper discharging base or tray and a rear face of the next discharged paper sheet. Thus, the paper sheet is discharged on the paper discharging base or tray in a state in which a horizontal posture of the paper sheet is approximately held.

The above second object of the present invention can be achieved by a paper discharging apparatus comprising a sheet guide arranging plate having bent portions for bending a sheet; the bent portions being formed on both sides of the sheet guide arranging plate with respect to a sheet conveying direction such that a sheet arranging face of each of the bent portions is higher than a central portion of the sheet arranging plate with respect to the sheet conveying direction; an endless belt wound around pulleys arranged on front and rear sides of the sheet guide arranging plate with respect to the sheet conveying direction; the endless belt being rotatably arranged between the pulleys to convey the sheet fed onto the sheet guide arranging plate onto a downstream side thereof; a plurality of air inlet ports disposed in the sheet guide arranging plate; and sucking means arranged in the vicinity of the sheet guide arranging plate and sucking air through the air inlet ports to press the sheet against the endless belt; the paper discharging apparatus being constructed such that the bent portions are arranged in parallel with the sheet conveying direction and the air inlet ports are arranged in the vicinity of the bent portions.

In this structure, the bent portions of the sheet arranging plate are arranged in parallel with the sheet conveying direction and the air inlet ports are disposed in the vicinity of the bent portions. Accordingly, the sheet is reliably held in a U-shape in cross section and is discharged by increasing a bending strength of the sheet in a longitudinal or conveying direction thereof.

In a first structure in a fifth embodiment of the present invention described later, the above third object of the present invention can be achieved by a paper discharging apparatus of a printer comprising a paper discharging section having a paper discharging base for stacking a sheet of paper having a printed image on a surface thereof; and a paper feeding section for feeding the paper sheet to this paper discharging section; the paper feeding section having a blowing member for sending a gas to a space between a surface of the paper sheet previously fed and a rear face of the next fed paper sheet; and the paper discharging section having a restraining member for restraining the gas supplied by the blowing member from being leaked on a side of the paper sheet.

In a second structure in the fifth embodiment of the present invention, the paper discharging base is constructed by a plurality of paper discharging trays for sequentially stacking the paper sheet thereon in the first structure in the fifth embodiment.

In a third structure in the fifth embodiment of the present invention, the restraining member has first and second restraining plates located on both sides of paper sheets stacked on the paper discharging base in the first structure in the fifth embodiment. The first restraining plate is integrated with the paper discharging base and the paper discharging apparatus further has means for separately moving the first and second restraining plates.

In a fourth structure in the fifth embodiment of the present invention, the first restraining plate can be opened and closed by rotating this first restraining plate around a side edge thereof in the first structure in the fifth embodiment. The paper discharging apparatus further has a detecting member for detecting an opening state of the first restraining plate and has pushing-out means for pushing the paper sheet out of the paper discharging base by a detecting signal of this detecting member.

In the first and second structures in the fifth embodiment of the present invention, a sheet of paper is printed by a printer and is fed by the paper feeding section to the paper discharging section. The paper sheet is then stacked on the paper discharging base. In this case, a gas is sent to a space between a surface of the paper sheet previously fed by the blowing member disposed in the paper feeding section and a rear face of the next fed paper sheet. The paper sheet is carried on a flow of the sent gas having a band shape until a predetermined position. Then, the paper sheet is sequentially stacked by its empty weight on the paper discharging base. In this case, the restraining member arranged on a side of the stacked paper sheet constructs a gas interrupting plate. Accordingly, the restraining member restrains the gas from being leaked and diffused on the side of the stacked paper sheet. Thus, the gas is straightly moved as a laminar flow and a gas pressure is approximately held constantly on front and rear sides of the paper sheet with respect to a sheet feeding direction. Therefore, no front end of the paper sheet hangs down even when the gas flow is formed in the shape of a thin band. No front end of the paper sheet also comes in frictional contact with a printed image face of the paper sheet previously fed. Accordingly, this printed image face and the front end of the moving paper sheet are not dirtied. Further, no paper sheet drops in a position different from a predetermined position.

In the third and fourth structures in the fifth embodiment of the present invention, the first and second restraining plates are located on both sides of paper sheets stacked on the paper discharging base. When the paper sheets are taken out of the paper discharging base, the first restraining plate is moved to an opening position thereof. The detecting member detects this opening position of the first restraining plate. The moving means moves the first restraining plate and the paper discharging base integrated with each other and moves the second restraining plate by a detecting signal of the detecting member. Accordingly, the second restraining plate constituting a pushing-out means pushes the paper sheets out of an opening portion of the paper discharging base. Thus, an operator can take the paper sheets out of the paper discharging base.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a paper discharging apparatus in the present invention will next be described in detail with reference to the accompanying drawings.

Figure 1:
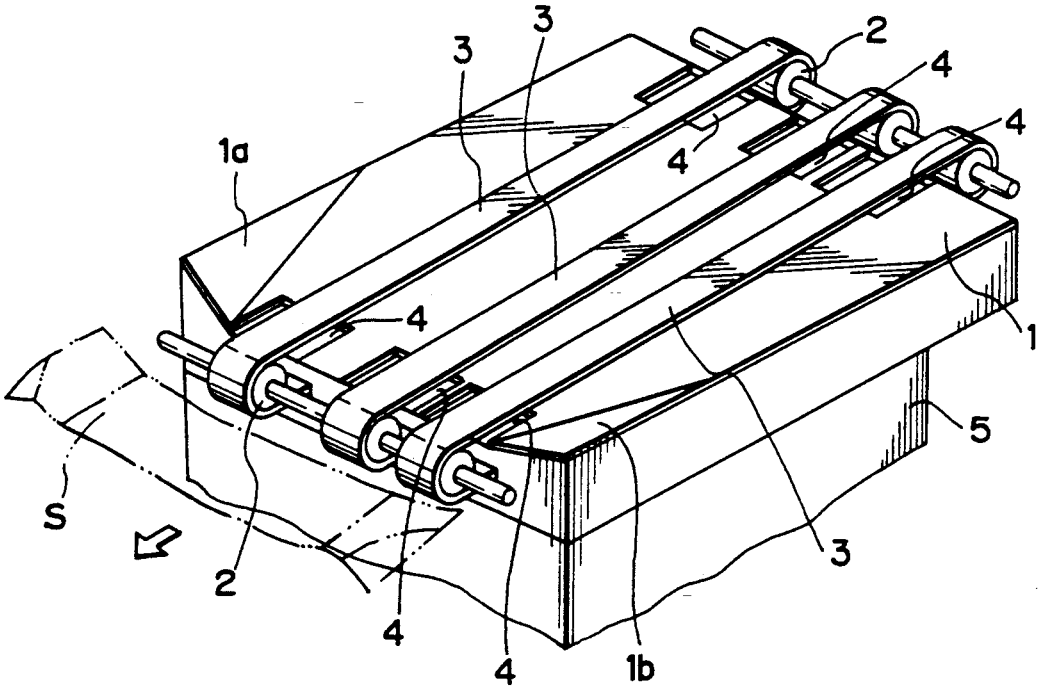
Fig. 1 (PRIOR ART)
FIG. 1 is a perspective view of a general paper discharging apparatus.

FIG. 1 shows a general paper discharging apparatus. For example, such a paper discharging apparatus is shown in Japanese Patent Application Laying Open (KOKAI) No. 60-148866.

This paper discharging apparatus has a sheet arranging plate 1 including bent portions 1*a* and 1*b*. The bent portion 1*a* and 1*b* are formed by slantingly bending and raising both sides of the sheet arranging plate 1 on a downstream side thereof in a sheet conveying or feeding direction. The paper discharging apparatus also has a plurality of endless belts 3 wound around pulleys 2 therebetween. The pulleys 2 are disposed on front and rear sides of the sheet arranging plate 1. The paper discharging apparatus also has a plurality of air inlet ports 4 formed in a central portion of the sheet arranging plate 1 on the front and rear sides thereof in the sheet feeding direction. The paper discharging apparatus further has a sucking device 5 disposed below the sheet arranging plate 1. The sucking device 5 sucks air through the air inlet ports 4 to press the sheet conveyed onto the sheet arranging plate 1 against the endless belts 3.

In this general paper discharging apparatus, the bent portions 1*a* and 1*b* of the sheet arranging plate 1 are formed by bending and raising both side end portions of the sheet arranging plate 1 on the downstream side thereof in the sheet conveying direction. Further, the air inlet ports 4 are disposed in central end portions of the sheet arranging plate 1 on the front and rear sides thereof in the sheet conveying direction. Accordingly, when a sheet of paper conveyed onto the sheet arranging plate 1 is strong in bending to a certain extent, the paper sheet is curved in a U-shape in cross section along a longitudinal direction thereof when front ends of the paper sheet are curved by the bent portions 1*a* and 1*b*. The paper sheet is discharged in a state in which this U-shape of the paper sheet is held even when the front ends of the paper sheet pass through the bent portions 1*a* and 1*b*.

In contrast to this, when the paper sheet is thin and has a weak bending strength, the U-shape of the paper sheet is formed only in a contact portion thereof coming in contact with the bent portions 1*a* and 1*b*. After the paper sheet passes through the bent portions 1*a* and 1*b*, both front end corners of the paper sheet hang down in accordance with its empty weight and curving state when the paper sheet is curved downwards. Accordingly, the paper sheet is formed in a W-shape or a reverse U-shape in cross section. Therefore, the paper sheet is discharged to a position located on the lower side of a paper discharging port. Accordingly, an image formed on a surface of the previously discharged paper sheet is dirtied by a frictional contact between the present and previous paper sheets. Further, a front end portion of the present paper sheet is caught by the previously discharged paper sheet so that the present and previous paper sheets are rounded on a paper discharging base and come into collision with the next discharged paper sheet, thereby causing a discharged paper jam.

Another paper discharging apparatus is proposed to solve these problems. This paper discharging apparatus has a structure similar to the above paper discharging structure, but an angle of inclination of each of the bent portions in the sheet arranging plate is set to be large. However, in this paper discharging apparatus, when a sheet of paper is discharged and a curving state of the sheet is returned to its original horizontal state, the paper sheet is greatly moved so that the paper sheet is irregularly arranged and stacked on the paper discharging base. Further, no paper sheet is straightly lowered along a paper discharging direction so that the paper sheet is moved forward and backward, and rightward and leftward and is then stacked on the paper discharging base. Therefore, the paper sheet is irregularly arranged on the paper discharging base. Further, since the paper sheet is greatly moved on printed paper sheets previously discharged and arranged, ink is scattered and stuck onto a rear face of the paper sheet so that the quality of an image formed on the rear face of the paper sheet is reduced.

Figure 2:
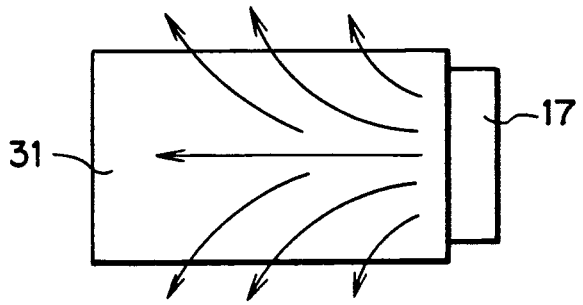
Fig. 2 (PRIOR ART)
FIG. 2 is an explanatory view showing a flowing state of air at a paper discharging time of another general paper discharging apparatus disposed in a printer.

As shown in FIG. 2, an air layer from a blowing member 17 flows out of the paper sheet at both side edges thereof as the paper sheet is moved forward above a paper discharging base 31 in the paper feeding direction. Accordingly, an air pressure is reduced so that no upper and lower paper sheets can be separated from each other. As a result, problems similar to those in the general paper discharging apparatus are caused. These problems cannot be effectively solved by the general paper discharging apparatus.

A paper discharging apparatus in accordance with each of first and second embodiments of the present invention will next be described in detail with reference to FIGS. 3 to 9.

For brevity, in the following description, apparent constructions, operations, objects and novel features are omitted or simplified in the drawings and specification.

Figure 3:
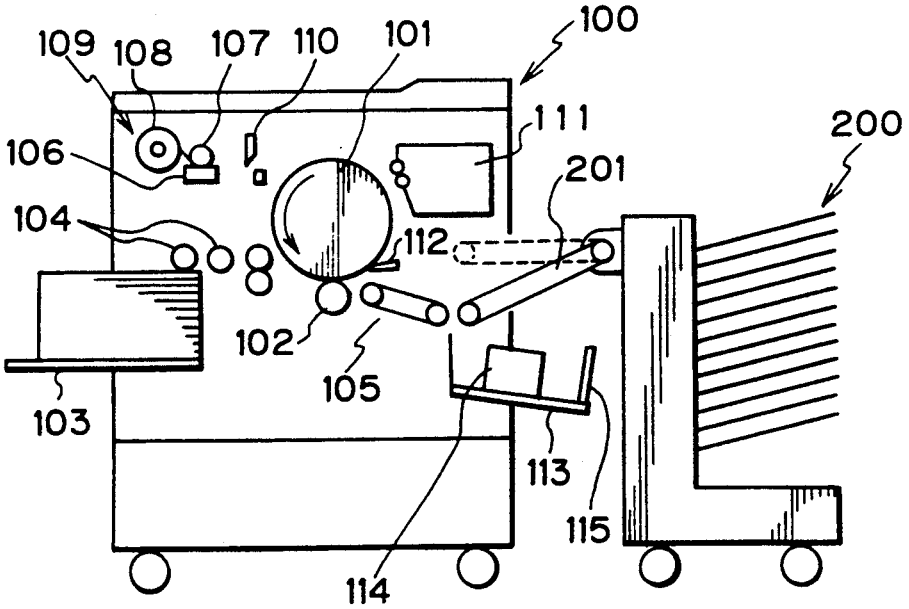
Fig. 3 (PRIOR ART)
FIG. 3 is a schematic cross-sectional view of a plate making printer of a hole printing type having a paper discharging apparatus in accordance with a first embodiment of the present invention.
Figure 4:
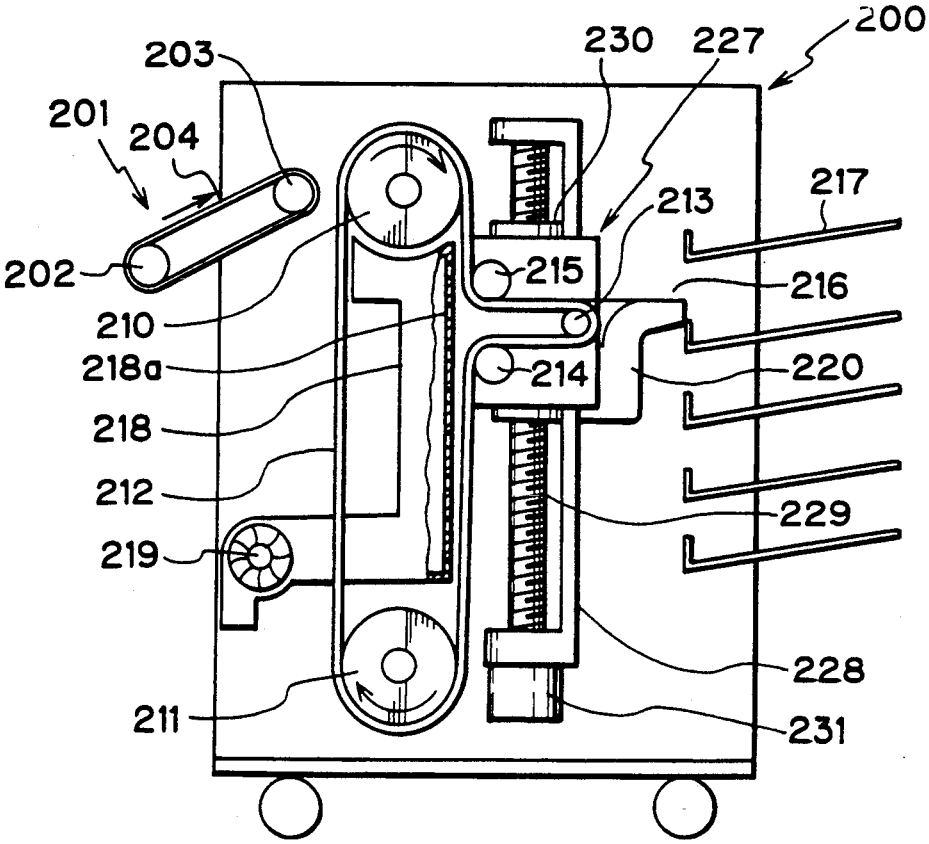
FIG. 4 is a schematic cross-sectional view of the paper discharging apparatus in the first embodiment of the present invention.

For example, as shown in FIGS. 3 and 4, the present invention is applied to a paper discharging apparatus in a combination of a plate making or photoengraving printer 100 of a hole printing type and a sorter 200 of an on-line type.

In FIG. 3, the plate making printer 100 of a hole printing type has a stencil paper clamping device on an outer circumferential face thereof. The plate making printer 100 has an ink supplying device on an inner circumferential side thereof. The stencil paper clamping device and the ink supplying device are not shown in FIG. 3. As shown in FIG. 3, the plate making printer 100 has a cylindrical printing drum 101 having a porous structure and rotated in the counterclockwise direction. The plate making printer 100 also has a pressing toller 102, a paper supplying base 103, paper feed rollers 104 and a forced paper-discharging conveying means 105 of a belt type. The plate making printer 100 also has a plate maker or photoengraver 109 for thermosensitively plate-making or photoengraving a sheet of stencil paper 108 stored in the shape of a roll by a thermal head 106 and a platen roller 107. The plate making printer 100 further has a cutter 110 for cutting stencil paper and a discharging collector 111 for separating a used sheet of stencil paper from the cylindrical printing drum 101 and collecting this used sheet.

In FIG. 3, sheets of paper set on the paper supplying base 103 are sequentially fed one by one by the paper feed rollers 104 from an uppermost paper sheet to the cylindrical printing drum 101.

An image is formed on a circumferential face of the cylindrical printing drum 101 and is printed on the fed sheet of paper between the cylindrical printing drum 101 and the pressing roller 102. Thereafter, the sheet of paper is separated from the cylindrical printing drum 101 by a separating claw 112.

The sheet of paper having the printed image thereon is then conveyed by the forced paper-discharging conveying means 105 outside the plate making printer 100 of a hole printing type.

No on-line type sorter 200 is used at a non-sorting time of the paper discharging apparatus. At this time, the position of a paper conveying guide means 201 of the on-line type sorter 200 is set to an escaping position shown by a broken line in FIG. 3. In this state, the sheet of paper discharged by the forced paper-discharging conveying means 105 is discharged and stacked on a paper discharging base 113 arranged on a side of the plate making printer 100 of a hole printing type.

A pair of paper-discharging side guide plates 114 and a paper-discharging end fence 115 are disposed on the paper discharging base 113 to regularly arrange and stack printed sheets of paper.

As shown in FIG. 4, in the paper conveying guide means 201 of the on-line type sorter 200, the sheet of paper discharged by the forced paper-discharging conveying means 105 from the plate making printer 100 of a hole printing type is conveyed into the on-line type sorter 200 by an endless belt 204 wound around a driven roller 202 and a driving roller 203 therebetween.

The driven roller 202 is selectively rotated around a support shaft of the driving roller 203 as a center of rotation such that a position of the driven roller 202 is set to one of positions shown by broken and solid lines in FIG. 3 in accordance with a paper discharging mode. The positions shown by broken and solid lines in FIG. 3 are respectively set at non-sorting and sorting times of the paper discharging apparatus.

The driven roller 202 of the paper conveying guide means 201 is rotated and moved to the position shown by the solid line in FIG. 3 in a paper discharging mode for using the on-line type sorter 200 described next.

As shown in FIG. 4, the on-line type sorter 200 has a cylindrical hollow main cylinder 210 having an opening in an outer circumference. The on-line type sorter 200 also has a driven cylinder 211 disposed below this main cylinder 210 and parallel to this main cylinder 210. The on-line type sorter 200 also has an endless belt 212 having a mesh shape and wound around the main cylinder 210 and the driven cylinder 211 therebetween. The on-line type sorter 200 also has a paper discharging section 216 formed by projecting a portion of the mesh-shaped endless belt 212 outwards by a lower guide roller 214, a middle guide roller 213 and an upper guide roller 215. The on-line type sorter 200 further has many paper discharging trays 217 spaced from each other at a constant distance on a side of this paper discharging section 216.

Each of the lower guide roller 214, the middle guide roller 213 and the upper guide roller 215 is disposed such that each of these rollers can be rotated around a central axis thereof.

An air sucking box 218 is arranged between the main cylinder 210 and the driven cylinder 211 and has an opening portion 218*a* arranged along the mesh-shaped endless belt 212.

This air sucking box 218 sucks and moves a printed sheet of paper onto a surface of the mesh-shaped endless belt 212 by a negative pressure caused near the opening portion 218*a* by the action of a sucking fan 219.

In FIG. 4, the main cylinder 210 is rotated by an unillustrated driving device in an arrow direction. The mesh-shaped endless belt 212 and the driven cylinder 211 are respectively rotated in arrow directions in accordance with this rotation of the main cylinder 210.

Thus, the sheet of paper is conveyed into the on-line sorter 200 and is then sucked and conveyed onto the surface on the mesh-shaped endless belt 212 by the negative pressure caused near the opening portion 218*a* of the air sucking box 218.

In the present invention, the paper discharging apparatus has a blowing means 220 for sending an air flow into a space between a front face of the sheet of paper previously discharged and arranged on the paper discharging tray 217 and the rear face of a sheet of paper next discharged.

Figure 5:
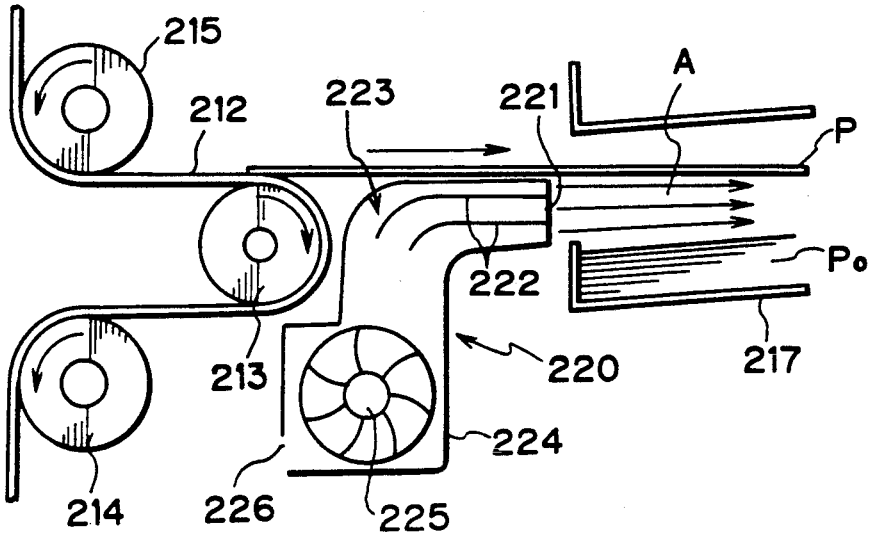
FIG. 5 is a schematic cross-sectional view for explaining an operation of the paper discharging apparatus in the first embodiment.

As shown in FIG. 5, this blowing means 220 has a blowout port 221 opened in a paper discharging direction, i.e., in the rightward direction in FIG. 5. The blowing means 220 also has a flow adjusting plate 222 for adjusting the air flow and has a blowing path 223 formed to surround the flow adjusting plate 222. The blowing means 220 also has a blowing fan 225 arranged at an end of a fan housing 224 forming the blowing path 223 on an air inlet side thereof. The blowing means 220 further has an air inlet port 226 formed at the air inlet side end of the fan housing 224.

In FIG. 5, the blowing fan 225 sucks external air through the air inlet port 226 and sends compressed air into the blowing path 223.

A flow of the air sent into this blowing path 223 is adjusted and changed by the flow adjusting plate 222 to laminar flows. Thus, an air flow in the shape of a thin band is emitted from the blowout port 221 to a space between a rear face of the paper sheet and the paper discharging tray 217.

As shown in FIG. 4, the blowing means 220 is integrated with the lower guide roller 214, the middle guide roller 213 and the upper guide roller 215 as a unit and is fixed to a slider 227.

In FIG. 4, the slider 227 is slidably arranged along a guide rail 228 arranged in a vertical direction. A nut 230 is fixed to the slider 227 and is screwed onto a screw 229 parallel to the guide rail 228. The slider 227 is vertically moved along the guide rail 228 by moving the nut 230 in accordance with rotation of the screw 229 by the operation of an elevating motor 231.

In FIGS. 4 and 5, a sheet P of paper is printed by the plate making printer 100 of a hole printing type and is conveyed into the on-line type sorter 200 through the paper conveying guide means 201. The sheet P of paper is then raised until a height corresponding to a predetermined paper discharging tray 217 through the slider 227 while the sheet P of paper is sucked and moved onto a surface of the mesh-shaped endless belt 212 by an action of the air sucking box 218. The sheet P of paper is thus discharged onto the predetermined paper discharging tray 217 through the fixed paper discharging section 216.

At this time, as shown in FIG. 5, an air flow A in the shape of a thin band is emitted from the blowout port 221 of the blowing means 220 in synchronization with a discharging operation of the paper sheet P. This air flow A is sent to a space between an uppermost printed image face of paper sheets $P_o$ previously-discharged and stacked on the paper discharging tray 217 and a rear face of the paper sheet P newly discharged.

Thus, the paper sheet P discharged from the paper discharging section 216 is discharged onto the paper discharging tray 217 in a state in which the paper sheet P is carried on the air flow A flowing on a rear face side thereof. The paper sheet P is thus stacked on the uppermost printed image face of the paper sheets $P_o$ previously discharged and stacked on the paper discharging tray 217.

As mentioned above, in accordance with the paper discharging apparatus of the present invention, the paper sheet P is approximately held in a horizontal posture and is discharged onto the paper discharging tray 217 by the air flow A sent by the blowing means 220 to the space between the uppermost front face of the paper sheets $P_o$ previously discharged and arranged on the paper discharging tray 217 and the rear face of the paper sheet P next discharged. Accordingly, it is possible to prevent a front end portion of the paper sheet P from hanging down at a discharging time thereof. Therefore, it is possible to prevent a printed image and the front end of the paper sheet from being damaged and dirtied by a frictional contact between this paper sheet P and the other paper sheets $P_o$.

Further, in this paper discharging apparatus, no paper discharging state of the paper sheet is changed in accordance with the bending strength of a paper sheet, etc. since the hanging-down of the front end of the paper sheet is prevented by the air flow. Furthermore, it is not necessary to dispose a guide member for horizontally maintaining a sheet of paper on the paper discharging tray. Therefore, it is possible to easily discharge sheets of paper onto many paper discharging trays each having a small paper discharging space in the on-line type sorter.

A paper discharging apparatus in accordance with a second embodiment of the present invention will next be described with reference to FIGS. 6 to 9.

Figure 7:
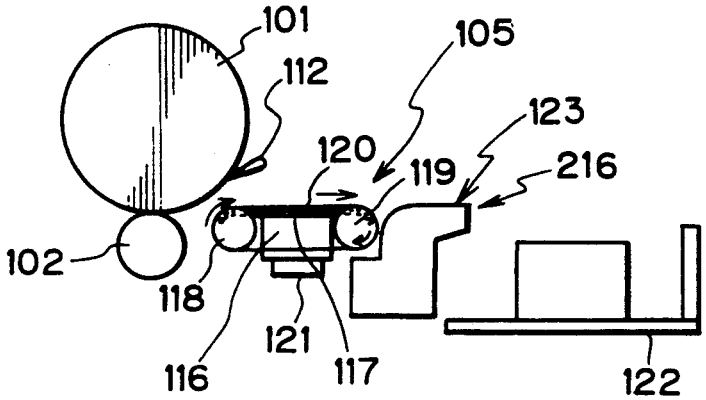
FIG. 7 is a schematic cross-sectional view of a plate making printer of a hole printing type having the paper discharging apparatus in the second embodiment.

In FIG. 7, an image is printed on a sheet of paper between a cylindrical printing drum 101 and a pressing roller 102. Similar to the first embodiment, the paper sheet is separated from the cylindrical printing drum 101 by a separating claw 112 and is then conveyed onto a paper discharging base 122 by a forced paper discharging device 105.

The forced paper discharging device 105 has a sucking box 116, a flat upper plate 117 having an opening portion, and a pair of pulleys 118, 119 arranged on both sides of the sucking box 116. The forced paper discharging device 105 also has an endless belt 120 wound around the pulleys 118 and 119 therebetween such that the sucking box 116 is surrounded by the endless belt 120. The forced paper discharging device 105 further has a sucking fan 121 disposed below the sucking box 116 and generating a negative pressure within the sucking box 116.

The sucking box 116 is constructed such that a printed sheet of paper is sucked and moved onto a surface of the endless belt 120 by a negative pressure caused by an action of the sucking fan 121 near an opening portion of the sucking box 116.

In FIG. 7, the pulley 118 is rotated by an unillustrated driving device in an arrow-direction. The endless belt 120 and the pulley 119 are respectively rotated in arrow directions in accordance with this rotation of the pulley 118.

Thus, the paper sheet separated from the cylindrical printing drum 101 is sucked and conveyed onto the surface of the endless belt 120 by the negative pressure caused near the opening portion of the sucking box 116.

Similar to the first embodiment, a paper discharging section 216 of the forced paper discharging device 105 for conveying a paper sheet has a blowing means 123. This blowing means 123 sends an air flow into a space between an uppermost front face of paper sheets previously discharged and arranged on the paper discharging base 122 and the rear face of a paper sheet next discharged.

Figure 6:
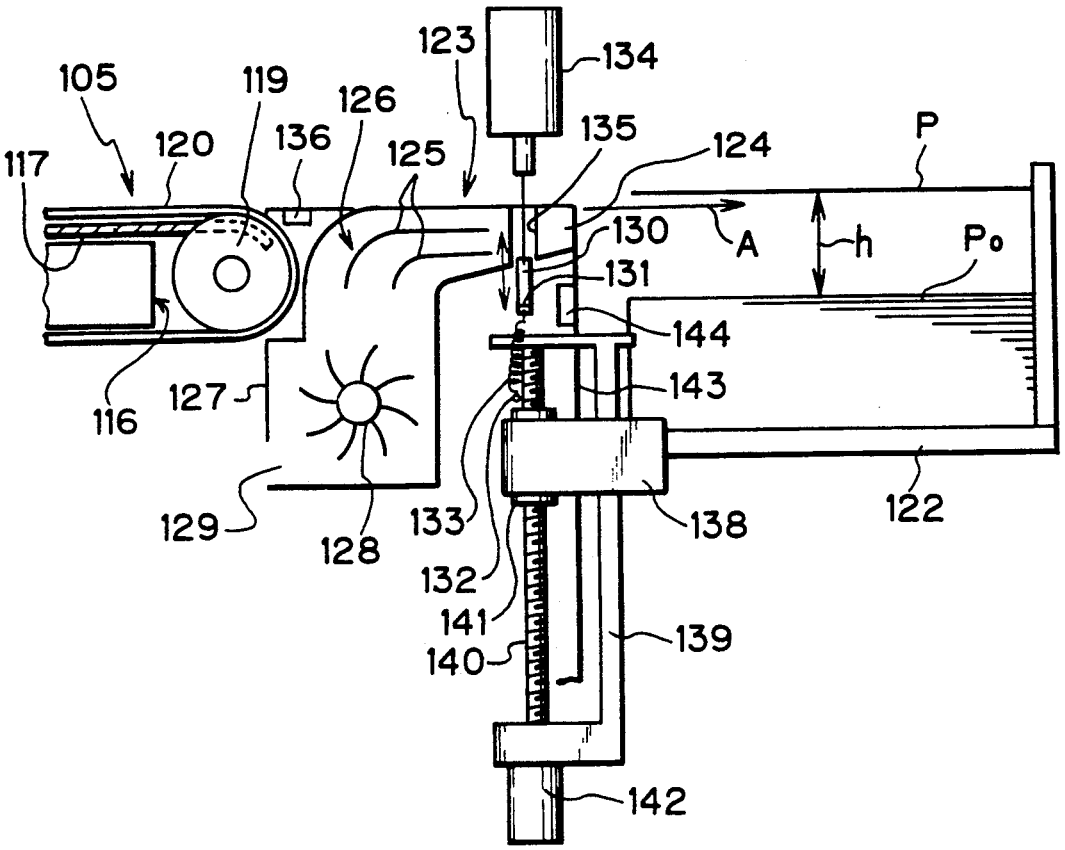
FIG. 6 is a schematic cross-sectional view of a paper discharging apparatus in accordance with a second embodiment of the present invention.

As shown in FIG. 6, this blowing means 123 has a blowout port 124 opened in a paper discharging direction, i.e., in the rightward direction in FIG. 6. The blowing means 123 also has a flow adjusting plate 125 for adjusting an air flow and has a blowing path 126 formed to surround the flow adjusting plate 125. The blowing means 123 also has a blowing fan 128 arranged at an end of a fan housing 127 for forming the blowing path 126 on an air inlet side thereof. The blowing means 123 further has an air inlet port 129 formed at the air inlet side end of the fan housing 127.

In FIG. 6, the blowing fan 128 sucks external air through the air inlet port 129 and sends compressed air into the blowing path 126.

The air sent into the blowing path 126 is adjusted and changed to laminar flows by the flow adjusting plate 125. The laminar flows are then emitted as an air flow in the shape of a thin band from the blowout port 124 to a space between the rear face of the paper sheet and the paper discharging base 122.

In this second embodiment, a shutter 130 for opening and closing the blowout port 124 at a suitable time is disposed in the vicinity of the blowout port 124 of the blowing means 123.

This shutter 130 is normally escaped from the blowout port 124 of the blowing means 123 by a coil spring 133. The coil spring 133 is connected between a hook 131 disposed at a lower end of the shutter 130 and another hook 132 disposed in a lower position of a printer body below the hook 131.

A solenoid 134 is arranged in an upper position opposite to the coil spring 133. The shutter 130 is slidably moved forward and backward along a guide groove 135 formed on a side of the blowout port 124 by turning the solenoid 134 on and off, thereby opening and closing the blowout port 124.

In FIG. 6, the shutter 130 is normally located in a lower escaping position to open the blowout port 124.

An air flow is emitted from this blowout port 124 simultaneously when an image begins to be printed on a sheet of paper by the plate making printer 100 of a hole printing type.

The paper sheet P printed by the plate making printer 100 is discharged toward the paper discharging base 122 through the paper discharging section 216 while the paper sheet P is sucked and moved onto a surface of the endless belt 120 by an action of the sucking box 116.

At this time, as shown in FIG. 6, an air flow A in the shape of a thin band is emitted from the blowout port 124 of the blowing means 123 in synchronization with a discharging operation of the paper sheet P. The air flow A is emitted to a space between an uppermost printed image face of paper sheets $P_o$ previously discharged and arranged on the paper discharging base 122 and a rear face of the paper sheet P newly discharged.

Thus, the paper sheet P discharged from the paper discharging section 216 is discharged onto the paper discharging base 122 while the paper sheet P is carried on the air flow A flowing on a rear face side thereof and is approximately held in a horizontal posture.

The solenoid 134 is turned on in a state in which the paper sheet P discharged from the paper discharging section 216 is moved by the air flow A flowing on the rear face side of the paper sheet until a position located above the paper discharging base 122. Thus, the shutter 130 is moved upwards against resilient force of the coil spring 133 so that the blowout port 124 of the blowing means 123 is closed.

Then, the air blowing operation from the blowout port 124 is stopped and the paper sheet P drops on the paper discharging base 122. The paper sheet P is thus stacked on the uppermost printed image face of the paper sheets $P_o$ previously discharged and stacked on the paper discharging base 122.

An operation of the solenoid 134 is controlled by detecting existence or nonexistence of the paper sheet P using a paper sensor 136 arranged in a paper path of the blowing means 123. The solenoid 134 is turned on and off in accordance with the discharging operation of the paper sheet to send and interrupt air from the blowing means 123.

As mentioned above, the paper discharging apparatus in the second embodiment of the present invention has effects similar to those obtained in the first embodiment. Further, the blowing operation of air from the blowout port 124 is stopped in a state in which the paper sheet P discharged from the paper discharging section 216 is moved until a position located above the paper discharging base 122. Accordingly, it is possible to more rapidly drop and stack the paper sheet P onto the paper discharging base 122. Therefore, it is possible to stack the paper sheet P on the discharged paper sheets without scattering the paper sheet P even when the paper sheet is discharged at a high speed.

Figure 8:
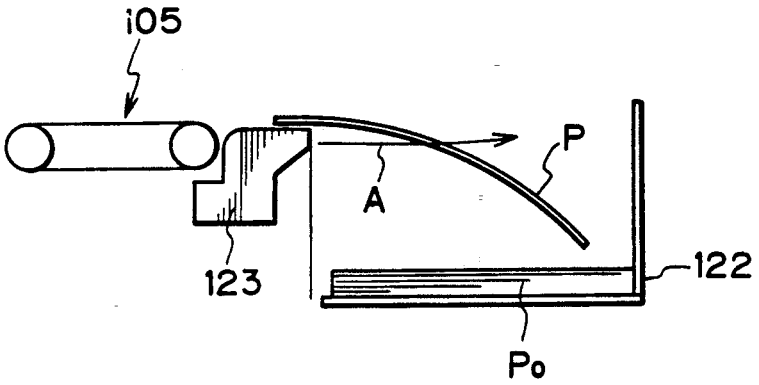
FIG. 8 is a schematic cross-sectional view of a paper discharging base disposed in the paper discharging apparatus in the second embodiment.

As shown in FIG. 8, a large space for stacking a large amount of paper sheets is disposed in the general paper discharging base 122 normally used. This space is disposed below a discharging position of the paper sheet P.

When the paper sheet P is discharged onto such a paper discharging base 122 for stacking a large amount of paper sheets by using the blowing means 123 in the second embodiment, a fall of the discharged paper sheet P until a stacking face thereof is large. Accordingly, a front end portion of the paper sheet P hangs down during the paper discharging operation. Therefore, as shown in FIG. 8, the air flow A is externally emitted from the blowing means 123 through a side portion of the paper sheet P so that no discharged paper sheet P can be horizontally maintained.

In such a case, it is possible to horizontally maintain the discharged paper sheet P to a certain extent by increasing an amount of the air flow A emitted from the blowing means 123.

However, when the amount of air flow A emitted from the blowing means 123 is increased, a rear end portion of the paper sheet P is swung by the air flow A when the paper sheet P is discharged and conveyed until a position located above a stacking position of the paper sheet. Therefore, a free fall of the paper sheet is obstructed and there is a fear that paper sheets are irregularly stacked on the paper discharging base.

Accordingly, when the paper sheet is discharged onto the paper discharging base 122 for stacking a large amount of paper sheets by using the blowing means 123 in the second embodiment, it is necessary to reduce a distance between the uppermost printed image face of the paper sheets $P_o$ previously discharged and stacked on the paper discharging base 122 and a rear face of the paper sheet P newly discharged. Namely, it is necessary to narrow the width of a passage of the air flow A emitted from the blowing means 123 to a certain extent. The amount of air flow A is thus adjusted and set to a relatively small amount such that no front end portion of the paper sheet P hangs down during the paper discharging operation.

Figure 9:
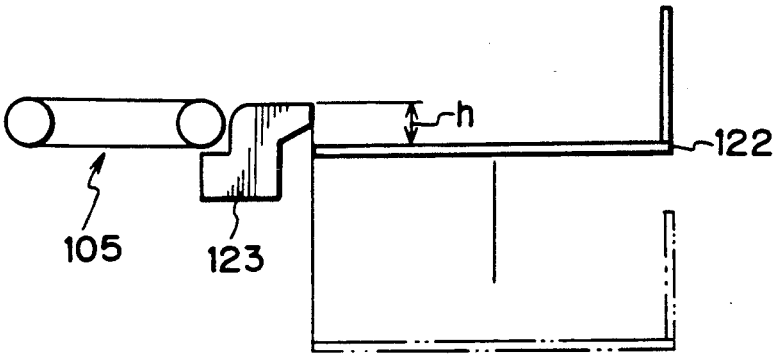
FIG. 9 is a schematic cross-sectional view of the paper discharging base after the paper discharging apparatus in the second embodiment is operated.

As shown in FIG. 9, the paper discharging base 122 for stacking a large amount of paper sheets thereon by using the blowing means 123 in the second embodiment is raised and lowered in accordance with a change in height of a stacking face of the discharged paper sheets. Thus, a distance h between the uppermost printed image face of the paper sheets $P_o$ previously discharged and stacked on the paper discharging base 122 and the rear face of the paper sheet P newly discharged is constantly held at any time by raising and lowering the paper discharging base 122.

As shown in FIG. 6, the paper discharging base 122 for stacking a large amount of paper sheets is fixed to a slider 138.

In FIG. 6, the slider 138 is slidably arranged along a guide rail 139 disposed in a vertical direction. A nut 141 is fixed to the slider 138 and is screwed onto a screw 140 parallel to the guide rail 139. The slider 138 is raised and lowered along the guide rail 139 by moving the nut 141 in accordance with rotation of the screw 140 using an elevating motor 142.

A paper position sensor 144 is attached to a front face plate 143 of the blowing means 123. The paper position sensor 144 detects an uppermost position of the paper sheets $P_o$ stacked on the paper discharging base 122. Thus, the elevating motor 142 raises and lowers the paper discharging base 122 for stacking a large amount of paper sheets in accordance with a change in stacking height of the discharged paper sheets. Therefore, the distance h between the uppermost printed image face of the paper sheets $P_o$ previously discharged and stacked on the paper discharging base 122 and the rear face of the paper sheet P newly discharged is controlled and constantly held at any time by raising and lowering the paper discharging base 122.

As shown in FIG. 9, when a printing operation is started, there is no paper sheet stacked on the paper discharging base 122 for stacking a large amount of paper sheets thereon by using the blowing means 123 in the second embodiment. In this state, the paper discharging base 122 is located in an uppermost position located by height h below a paper discharging position. The paper discharging base 122 is sequentially lowered from the uppermost position in accordance with a change in stacking height of printed and discharged paper sheets such that the distance h between the uppermost printed image face of the paper sheets $P_o$ previously discharged and stacked on the paper discharging base 122 and the rear face of the paper sheet P newly discharged is constantly held at any time.

In accordance with the paper discharging apparatus in each of the first and second embodiments of the present invention, a sheet of paper is discharged by a blowing means onto a paper discharging base while a horizontal posture of the paper sheet is approximately held by an air flow sent to a space between an uppermost front face of paper sheets previously discharged and stacked on the paper discharging base and a rear face of the paper sheet next discharged. Accordingly, it is possible to prevent a front end portion of the paper sheet from hanging down at a paper discharging time. Further, it is possible to prevent a printed image and a front end of the paper sheet from being damaged and dirtied by a frictional contact between this paper sheet and the other stacked paper sheets.

Further, in this paper discharging apparatus, no discharging state of the paper sheet is changed in accordance with a bending strength of the paper sheet, etc. since the hanging-down of the paper sheet at a front end thereof is prevented by the air flow. Further, it is not necessary to dispose a guide member for horizontally maintaining the paper sheet on a paper discharging tray. Accordingly, it is possible to easily discharge sheets of paper onto many paper discharging trays each having a small paper discharging space in an on-line type sorter.

Figure 10:
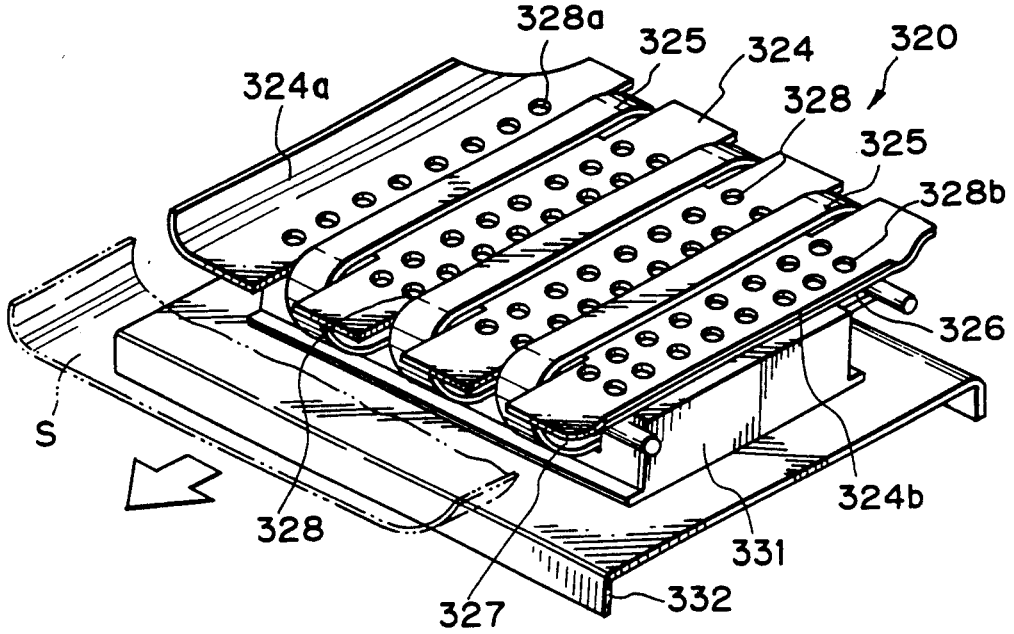
FIG. 10 is a perspective view showing a paper discharging apparatus in accordance with a third embodiment of the present invention.

A paper discharging apparatus in accordance with a third embodiment of the present invention will next be described in detail with reference to FIGS. 10 and 11.

Figure 11:
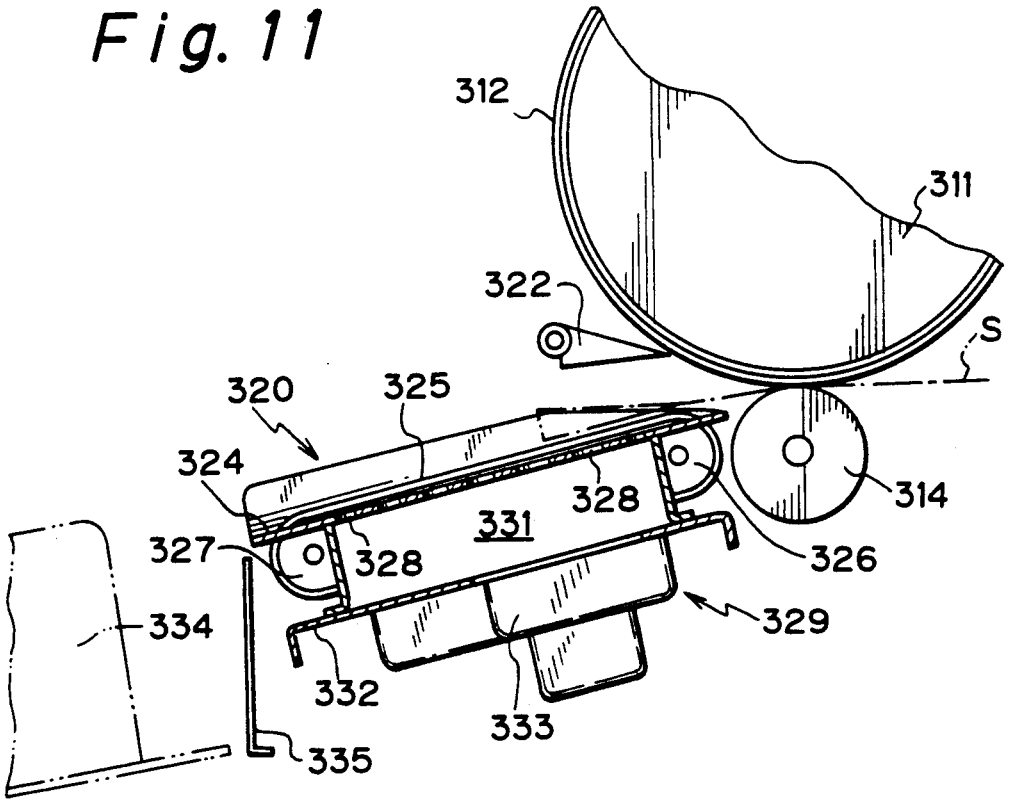
FIG. 11 is a cross-sectional view of the paper discharging apparatus applied to a rotary stencil duplicator in the third embodiment.

FIG. 11 shows a paper discharging apparatus applied to a rotary printer in the present invention. In FIG. 11, a cylindrical printing drum 311 has a porous structure. A perforated sheet of hole printing stencil paper 312 is wound around an outer circumferential face of the cylindrical printing drum 311. The cylindrical printing drum 311 is rotated by an unillustrated driving device in the clockwise direction in FIG. 11. A sheet S is fed to a clearance between a pressing roller 314 and the printing drum 311. Thus, the pressing roller 314 approaches the printing drum 311 from a state in which the pressing roller 314 is separated from the printing drum 311. The pressing roller 314 then presses the sheet S against the printing drum 311 so that the sheet S is inked to print an image thereon. A separating claw 322 is supported by a shaft thereof and can be rotated around this shaft. A sharp end of the separating claw 322 approaches a surface of the printing drum 311 and is engaged with the sheet S stuck onto the surface of the printing drum 311. The sheet S is then separated by the separating claw 322 from the surface of the printing drum 311 in accordance with rotation of the printing drum 311.

A paper discharging device 320 has a sheet arranging plate 324, a plurality of endless belts 325 and a sucking device 329 arranged below the sheet arranging plate 324. The endless belts 325 are wound around pulleys 326 and 327 therebetween and these pulleys 326 and 327 are disposed on front and rear sides of the sheet arranging plate 324. As shown in FIG. 10, the sheet arranging plate 324 has bent portions **324*a* and 324*b*. The bent portions 324*a* and 324*b* are formed by inwardly bending and raising both side portions of the sheet arranging plate 324 in parallel with a sheet conveying direction such that each of the bent portions 324*a* and 324*b* is higher than a central portion of the sheet arranging plate 324 with respect to the sheet conveying direction. The sheet arranging plate 324 has a plurality of air inlet ports 328. Air inlet ports 328*a* and 328*b* are respectively disposed in the vicinity of the bent portions 324*a* and 324*b* and are parallel to the bent portions 324*a* and 324*b***.

The sucking device 329 is constructed by a duct 331, a base 332 and a fan motor 333. Reference numerals 334 and 335 respectively designate a paper discharging base and a side cover of the paper discharging device.

The sheet S separated from the surface of the printing drum 311 by the separating claw 322 is arranged on the sheet arranging plate 324. The sheet S is then conveyed in the sheet conveying direction while the sheet S is pressed against the belts 325 by sucking air through the air inlet ports 328 by driving the fan motor 333. At this time, both sides of the sheet S are guided by the bent portions 324*a* and 324*b* while the sheet S is sucked by the air through the air inlet ports 328*a* and 328*b*. Accordingly, the sheet S is inwardly curved in an approximately U-shape in cross section in a forming range of the bent portions 324*a* and 324*b* in a width direction of the sheet S. The sheet S is discharged in this curving state. Namely, the sheet S is discharged while a bending strength of the sheet S in a longitudinal or feeding direction thereof is increased in the forming range of the bent portions 324*a* and 324*b* in the width direction of the sheet S. Thus, the sheet S is discharged on the sheet discharging base 334 without curving the sheet S at a large angle in a state in which the bending strength of the sheet is increased in a wide range thereof.

In this case, bending widths of the sheet S on both sides thereof are preferably set to about 10% of a sheet width.

A paper discharging apparatus in a fourth embodiment of the present invention will next be described in detail with reference to FIGS. 12 and 13.

The paper discharging apparatus in this fourth embodiment is characterized by air inlet ports disposed in a sheet arranging plate. Therefore, FIGS. 12 and 13 show only the sheet arranging plate. The other constructions are similar to those in the third embodiment and a detailed explanation thereof is therefore omitted in the following description by using the same reference numerals in FIGS. 12 and 13.

Figure 12:
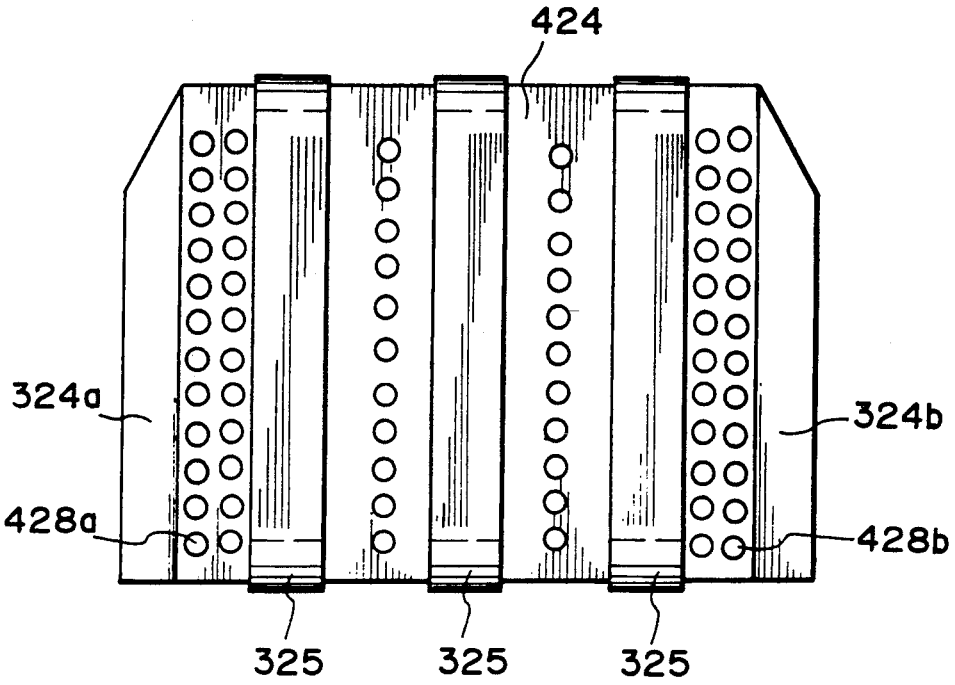
FIG. 12 is a plan view of a paper discharging apparatus in accordance with a fourth embodiment of the present invention.
Figure 13:
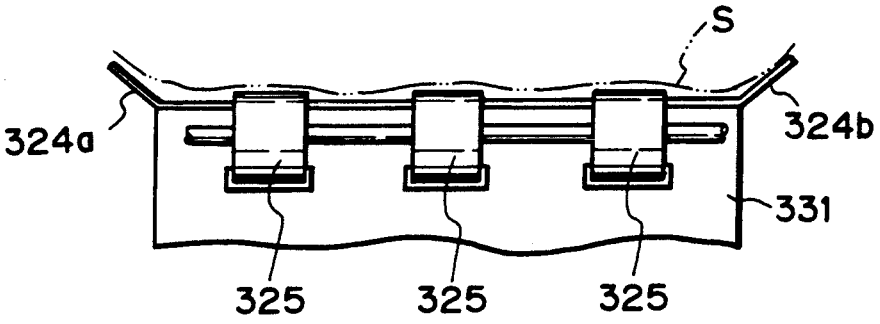
FIG. 13 is a front view of the paper discharging apparatus in the fourth embodiment.

In FIGS. 12 and 13, a plurality of air inlet ports 428 are formed in a sheet arranging plate 424. The air inlet ports 428 include air inlet ports 428*a* and 428*b* respectively formed in the vicinity of bent portions 324*a* and 324*b*. The number of air inlet ports 428*a* is set to be larger than that in a central portion of the sheet arranging plate 424. The number of air inlet ports 428*b* is also set to be larger than that in the central portion of the sheet arranging plate 424. Force for sucking a sheet of paper in the vicinity of the bent portions 324*a* and 324*b* is increased by increasing the number of air inlet ports in comparison with the central portion of the sheet arranging plate 424. In such a structure, a thick sheet of paper can be reliably curved to increase a bending strength thereof in a sheet longitudinal or feeding direction and is discharged in this curving state.

In accordance with the third and fourth embodiments of the present invention, both sides of a sheet are reliably sucked in a forming range of bent portions. The sheet is then discharged while the sheet is curved. Accordingly, it is possible to reliably hold the sheet in an approximately U-shape in cross section so that a bending strength of the sheet is increased in a longitudinal or feeding direction thereof. Accordingly, no image formed on a surface of the previously discharged sheet is usually dirtied by a frictional contact between the present and previous sheets. Further, there is usually no case in which a front end portion of the present sheet is caught by the previously discharged sheet so that the present and previous sheets are rounded on a paper discharging base and come into collision with the next discharged sheet. Accordingly, no discharged paper jam is usually caused in this paper discharging apparatus. Further, it is not necessary to increase an angle of inclination of each of the bent portions on both sides of the sheet arranging plate. Accordingly, no discharged sheet is greatly moved when the sheet is stacked on the paper discharging base. Accordingly, discharged sheets are regularly arranged on the paper discharging base and it is possible to prevent an image formed on the rear face of a sheet from being damaged and dirtied.

FIGS. 14 to 22 show a paper discharging apparatus of a printer in accordance with a fifth embodiment of the present invention.

Figure 14:
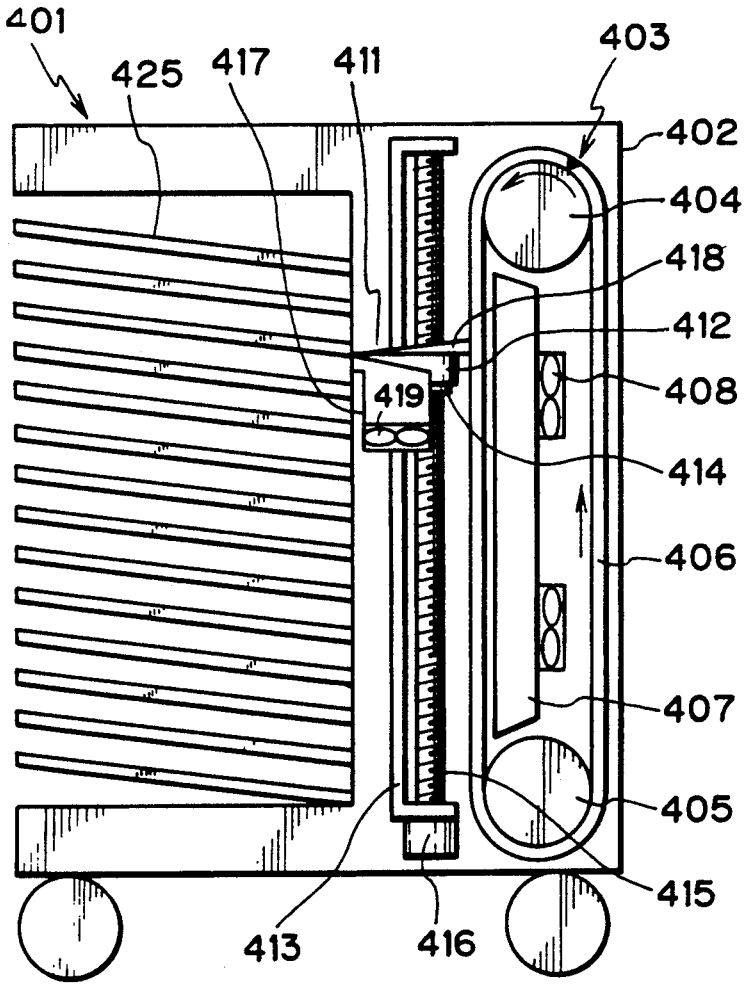
FIG. 14 is a schematic front view of a paper discharging apparatus of a printer in accordance with a fifth embodiment of the present invention.

In FIG. 14, a paper discharging apparatus 401 is constructed by an on-line type sorter. A conveying section 403 is disposed on one-side of a body 402 of the paper discharging apparatus. This conveying section 403 has a main cylinder 404 and a driven cylinder 405 respectively supported rotatably by upper and lower portions of the conveying section 403. The main cylinder 404 and the driven cylinder 405 have openings in outer circumferential portions thereof. The conveying section 403 also has an endless belt 406 wound around these cylinders 404 and 405 therebetween and having a mesh shape. The conveying section 403 further has an air inlet box 407 disposed between the cylinders 404 and 405 and having an opening portion along an inner face of the endless belt 406. The main cylinder 404 is rotated by an unillustrated driving device in an arrow direction in FIG. 14. An air inlet fan 408 is attached to the air inlet box 407.

A paper feeding section 411 is arranged on a side opposite to the air inlet box 407 with respect to the endless belt 406. This paper feeding section 411 has a guide rail 413 attached to the apparatus body 402 in parallel with the endless belt 406. The paper feeding section 411 further has a screw bar 415 rotatably supported by upper and lower bent portions of the guide rail 413. A lower end of the screw bar 415 is connected to a motor 416. A nut 414 is screwed onto the screw bar 415 and is attached to a slider 412. The slider 412 is raised and lowered along the guide rail 413 in accordance with rotation of the screw bar 415. A blowing member 417 and a distributing claw 418 are disposed in the slider 412. A blow fan 419 and a blowing port 420 are disposed in the blowing member 417.

Figure 15:
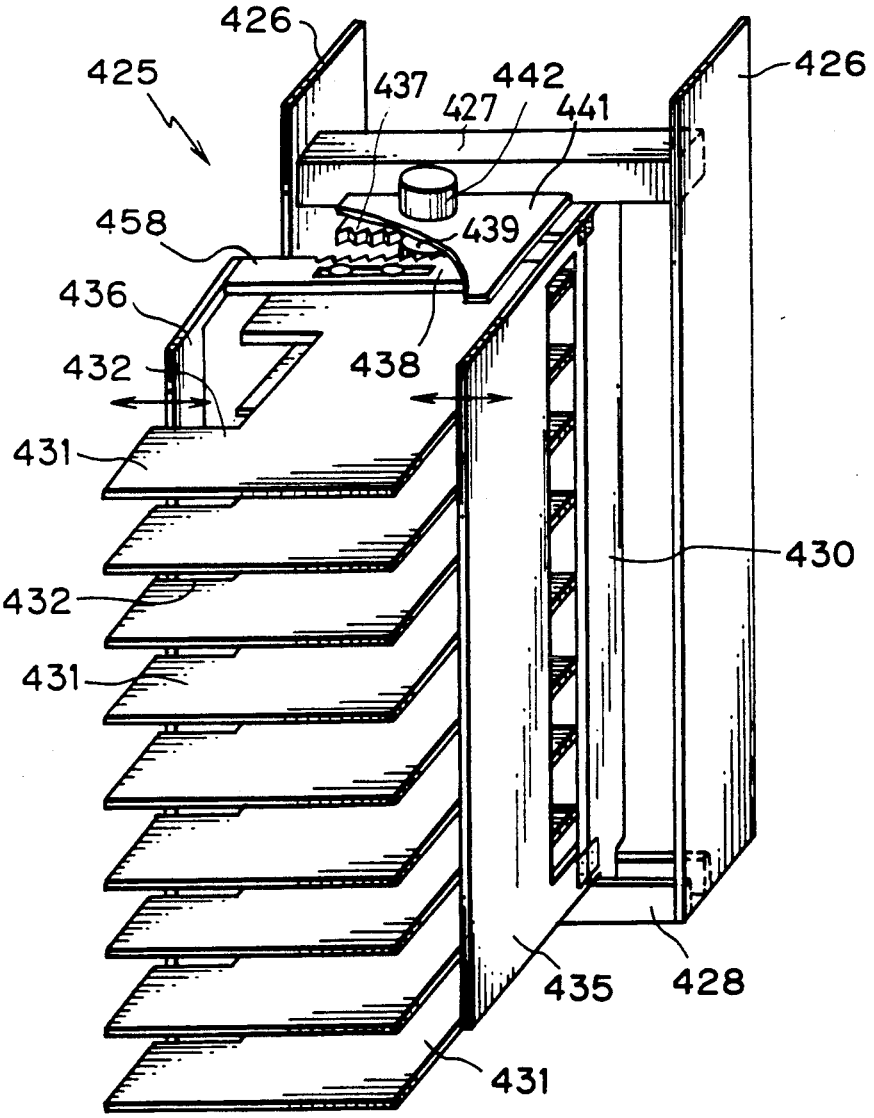
FIG. 15 is a perspective view of a paper discharging section disposed in the paper discharging apparatus in the fifth embodiment of the present invention.
Figure 16:
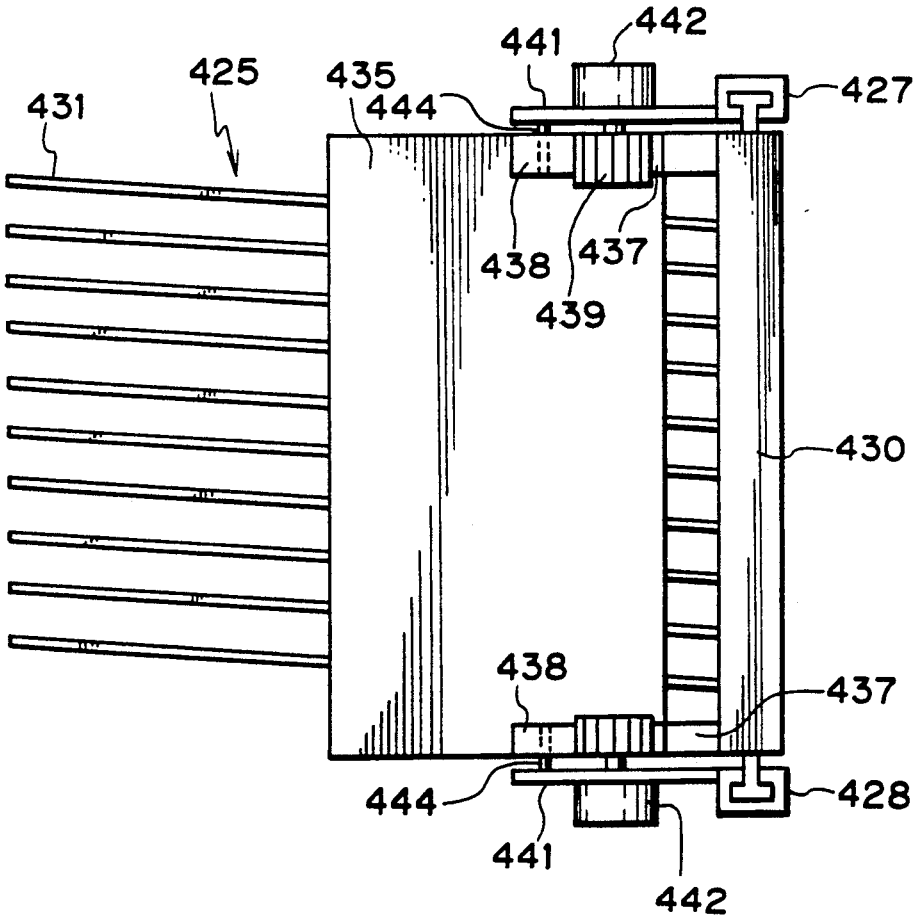
FIG. 16 is a front view showing one constructional portion of the paper discharging apparatus in the fifth embodiment.
Figure 17:
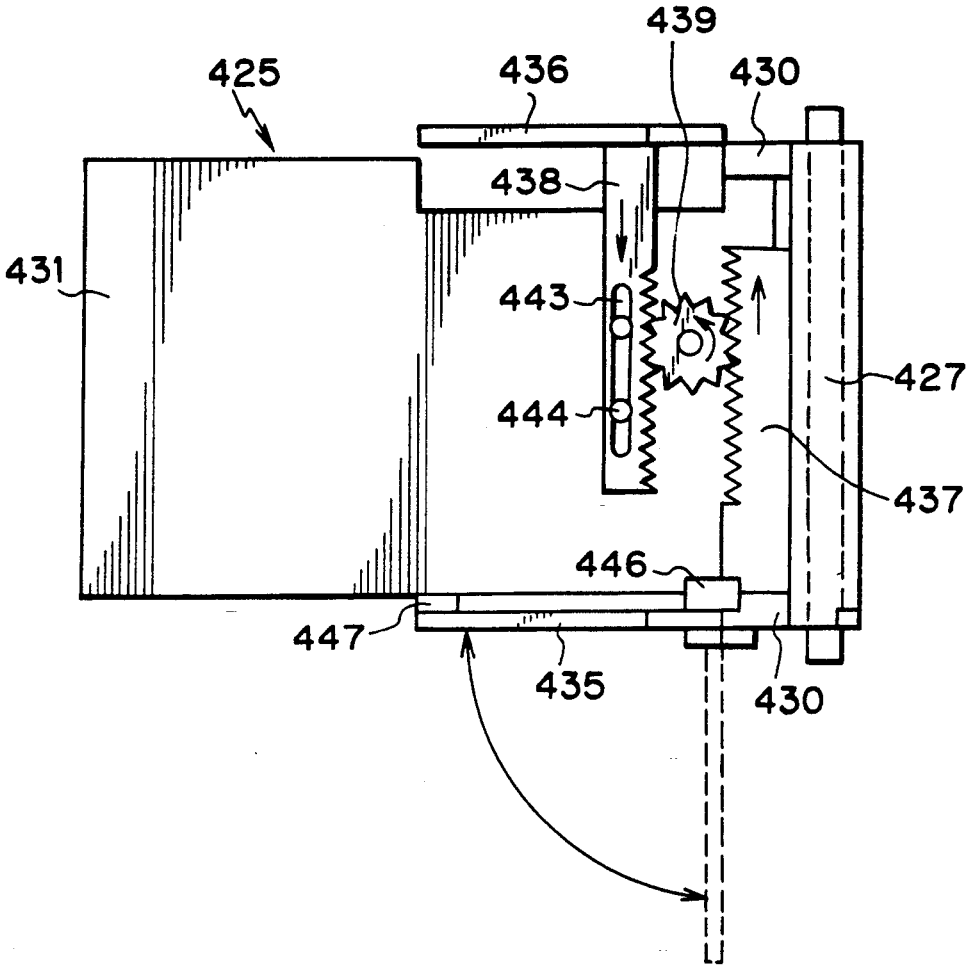
FIG. 17 is a plan view of this constructional portion of the paper discharging apparatus in the fifth embodiment.
Figure 18:
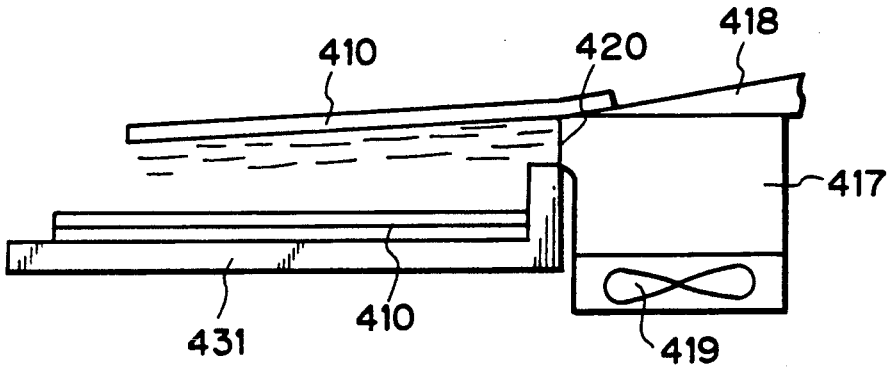
FIG. 18 is an explanatory view showing a paper discharging state of a paper discharging base disposed in the paper discharging apparatus in the fifth embodiment.

FIGS. 15 to 17 show a paper discharging section 425 in detail. Upper and lower portions of side plates 426 of the body 402 of the paper discharging apparatus 401 are connected to each other by horizontal guide rails 427 and 428. A pair of longitudinal brackets 430 are spaced from each other. Upper and lower ends of the longitudinal brackets 430 are slidably fitted into the guide rails 427 and 428. A paper discharging base 431 is constructed by a plurality of trays and is supported by these longitudinal brackets 430. A recessed notch portion 432 is formed on one side of the paper discharging base 431. First and second restraining plates 435 and 436 are vertically disposed along both sides of the paper discharging base 431. A basic end of the first restraining plate 435 is pivotally supported by a front edge of one of the longitudinal brackets 430 so as to open and close the first restraining plate 435. The second restraining plate 436 has a width set such that this second restraining plate 436 can be moved into the recessed notch portion 432 and away from the recessed notch portion 432. The second restraining plate 436 can be moved in an arrow direction in FIG. 15 with respect to the paper discharging base 431.

As shown in FIG. 17, a first rack plate 437 is transversally attached to one of the longitudinal brackets 430. A second rack plate 438 is transversally attached to the second restraining plate 436. The first rack plate 437 and the second rack plate 438 are opposed to each other. A pinion 439 is arranged between these rack plates 437 and 438 and is engaged with these rack plates. This pinion 439 is attached to the driving shaft of a motor 442 supported by a transversal bracket 441 extending from each of the guide rails 427 and 428 (see FIG. 16). As shown in FIG. 17, a slot 443 is longitudinally disposed in the second rack plate 438. A pin 444 is slidably fitted into this slot 443 and is attached to the transversal bracket 441. A detecting member 446 is attached to each of the longitudinal brackets 430. The detecting member 446 detects opening and closing states of the first restraining plate 436 and is constructed by a microswitch, etc. A magnet 447 is also attached to one of the longitudinal brackets 430. The magnet 447 is used to attract the first restraining plate 436 closed at one side edge of the paper discharging base 431.

In the above paper discharging apparatus, a sheet of paper 410 is printed by a printer and is discharged to the conveying section 403 by an unillustrated discharging means. The paper sheet 410 is then fed from the right-hand side in FIG. 14 onto the mesh-shaped endless belt 406 in a position located above the main cylinder 404. The paper sheet 410 is sucked and moved onto the mesh-shaped endless belt 406 by sucking force caused within the air inlet box 407, thereby lowering the paper sheet 410. The blowing member 417 is stopped in a predetermined position by rotating the screw bar 415 by driving the motor 416 in the paper feeding section 411. The paper sheet 410 is moved onto the distributing claw 418 disposed on this blowing member 417. The paper sheet 410 is then moved forward and is sucked by the fan 419 during this forward movement.

Air is compressed within the blowing member 417 and is emitted in a band shape from the blowing port 420. This air is sent to a space between a front face of the paper sheet 410 previously fed and a rear face of the next fed paper sheet. The paper sheet 410 is conveyed until a predetermined position while the paper sheet 410 is carried on a band-shaped flow of the sent air. Then, the paper sheet 410 is sequentially stacked on the paper discharging base 431 by its empty weight. The above paper conveying operation is similar to that in the general paper discharging apparatus of this kind.

Figure 19:
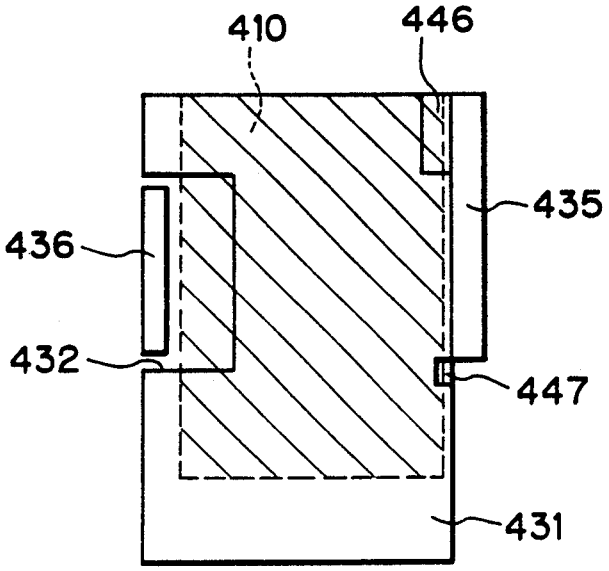
FIG. 19 is an explanatory view showing a state in which sheets of paper are arranged on the paper discharging base in the paper discharging apparatus in the fifth embodiment.
Figure 20:
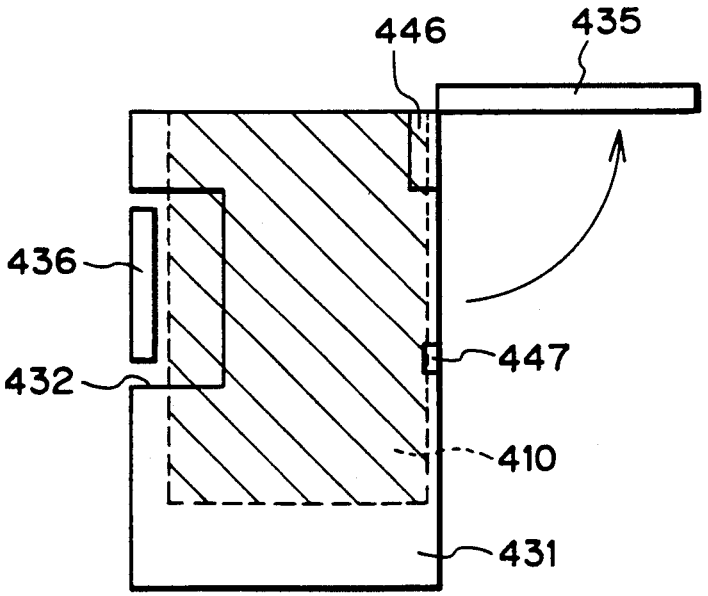
FIG. 20 is an explanatory view showing an opening state of a first restraining plate disposed in the paper discharging apparatus in the fifth embodiment.
Figure 21:
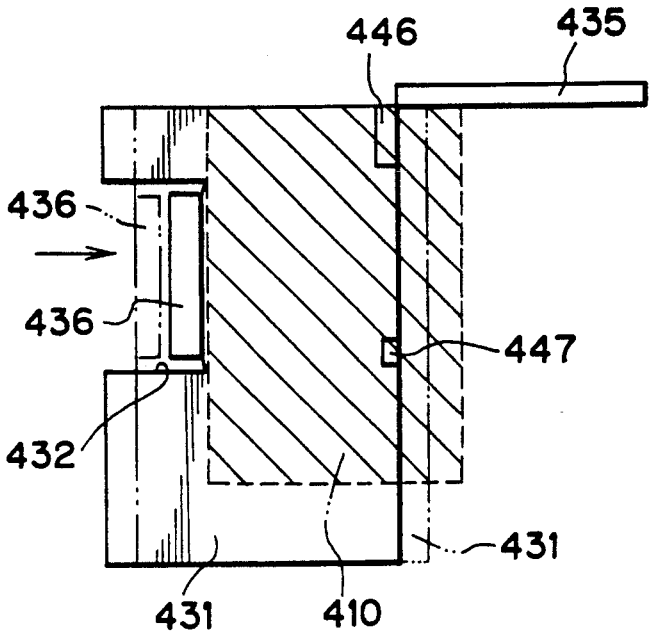
FIG. 21 is an explanatory view showing a paper taking-out state of the paper discharging apparatus in the fifth embodiment.
Figure 22:
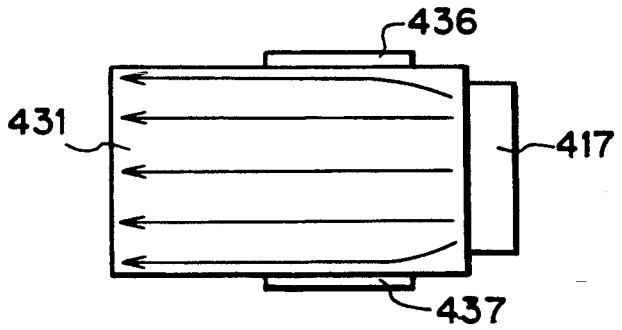
FIG. 22 is an explanatory view showing a flowing state of air at a paper discharging time of the paper discharging apparatus in the fifth embodiment.

Thus, as shown by slanting and dotted lines in FIG. 19, the paper sheet 410 is stacked on the paper discharging base 431. In the meantime, the first restraining plate 435 is located in a closing position shown by a solid line in FIG. 17 so that the first restraining plate 435 is attracted by the magnet 447. As a result, the first and second restraining plates 435 and 436 form an air interrupting plate along both side edges of the paper discharging base 431. Accordingly, the first and second restraining plates 435 and 436 restrain air from being diffusively leaked on sides of the paper discharging base 431. Accordingly, no air flow on the paper discharging base 431 is diffused on both sides thereof as shown in FIG. 2. This air flow is straightly moved as a laminar flow as shown in FIG. 22 so that an air pressure is approximately held uniformly on front and rear sides of the air flow with respect to an air sending direction. Accordingly, no front end of the paper sheet 410 hangs down even when the air flow is formed in the shape of a thin band. Therefore, no front end of the present paper sheet 410 comes in frictional contact with a printed image face of the paper sheet 410 previously fed. Accordingly, image faces of the previous and present sheets and the front end of the moving present sheet are not dirtied. Further, no paper sheet drops in a position different from a predetermined position.

Thus, the paper sheet is completely discharged to the paper discharging apparatus 401. When stacked paper sheets 410 are taken out of the paper discharging base 431, the first restraining plate 435 is rotated and moved to an opening position shown in FIG. 20. The detecting member 446 detects this opening position of the first restraining plate 435 and drives the motor 442. Thus, the pinion 439 is rotated in an arrow direction shown in FIG. 17 so that the first and second rack plates 437 and 438 are respectively moved in arrow directions.

The first restraining plate 435 and the paper discharging base 431 are connected to the first rack plate 437 through the longitudinal brackets 430. The second restraining plate 436 is connected to the second rack plate 438. The first restraining plate 435 and the paper discharging base 431, and the second restraining plate 436 are moved in opposite directions from positions shown by chain lines to positions shown by solid lines in FIG. 21. Thus, the second restraining plate 436 is moved into the recessed notch portion 432 of the paper discharging base 431 in an arrow direction in FIG. 21. Accordingly, the paper sheets 410 are pushed out of an opening portion of the paper discharging base 431 on a side opposite to the second restraining plate 436 with respect to the paper sheets. Thus, an operator can take the paper sheets 410 out of the paper discharging base 431 by gripping pushed portions of the paper sheets 410.

As mentioned above, in first and second structures in the fifth embodiment of the present invention, a paper discharging apparatus has a paper discharging section having a paper discharging base for stacking a printed sheet of paper. This paper discharging apparatus also has a paper feeding section for feeding the paper sheet to this paper discharging section. The paper feeding section has a blowing member for sending a gas to a space between a surface of the paper sheet previously fed and a rear face of the next fed paper sheet. The paper discharging section has a restraining member for restraining the gas supplied by the blowing member from being leaked on a side of the paper sheet.

Accordingly, no front end of a sheet of paper hangs down even when an air flow is formed in the shape of a thin band. Therefore, no front end of the present paper sheet comes in frictional contact with a printed image face of the paper sheet previously fed. Accordingly, image faces of the previous and present sheets and the front end of the moving present sheet are not dirtied. Further, no paper sheet drops in a position different from a predetermined position so that no discharged paper sheets are scattered as a whole. Accordingly, the discharged paper sheets are reliably stacked regularly in a small space. Further, no large amount of sent air is required so that the entire paper discharging apparatus is made compact and no large space for arranging the paper discharging apparatus is required.

In third and fourth structures in the fifth embodiment of the present invention, the restraining member has first and second restraining plates located on both sides of paper sheets stacked on the paper discharging base in the first structure in the fifth embodiment. The first restraining plate is integrated with the paper discharging base and the paper discharging apparatus further has means for separately moving the first and second restraining plates. The first restraining plate can be opened and closed by rotating this first restraining plate around a side edge thereof. The paper discharging apparatus further has a detecting member for detecting an opening state of the first restraining plate, and has pushing-out means for pushing the paper sheet out of the paper discharging base by a detecting signal of this detecting member.

When stacked paper sheets are taken out of the paper discharging base, the first restraining plate is moved to an opening position thereof. The detecting member detects this opening position of the first restraining plate. The moving means moves the first restraining plate and the paper discharging base integrated with each other and also moves the second restraining plate by a detecting signal of the detecting member. Thus, the second restraining plate constituting the pushing-out means pushes the paper sheets out of an opening portion of the paper discharging base. Accordingly, an operator can take the paper sheets out of the paper discharging base.

Accordingly, when the paper sheets are taken out of the paper discharging base, it is not necessary to dispose a notch for gripping the paper sheets. Therefore, it is possible to increase an amount of the discharged paper sheets by increasing a mechanical strength of the paper discharging base. Further, it is very easy to grip and take the paper sheets out of the paper discharging base by disposing the opening portion for taking them out in a front portion of the paper discharging apparatus.

Many widely different embodiments of the present invention may be constructed without departing from the spirit and scope of the present invention. It should be understood that the present invention is not limited to the specific embodiments described in the specification, except as defined in the appended claims.

What is claimed is:

1. A paper discharging apparatus for sequentially discharging a sheet of paper having an image on a surface thereof and stacking the paper sheet on a paper discharging base, the paper discharging apparatus comprising:

transport means for transporting a paper sheet toward said paper discharging base, said transport means including an end at which a paper sheet exits said transport means;

blowing means for sending a gas flow to a space between a surface of the paper sheet previously discharged and arranged on said paper discharging base and a rear face of the next discharged paper sheet as the next discharged paper sheet exits said end of said transport means; and mounting means for mounting said end of said transport means and said blowing means for moving said end of said transport means and said blowing means together in a vertical direction.

2. A paper discharging apparatus as claimed in claim 1, wherein the paper discharging apparatus is used in a printer.

3. A paper discharging apparatus as claimed in claim 1, wherein the paper discharging base is constructed by a plurality of paper discharging trays.

4. A paper discharging apparatus as claimed in claim 1, wherein the blowing means comprises a blowout port opened in a paper discharging direction.

5. The paper discharging apparatus of claim 1, wherein said mounting means includes a slider mounted upon a screw such that rotation of said screw causes vertical movement of said slider with said end of said transport means and said blowing means moving therewith.

6. A paper discharging apparatus for sequentially discharging a sheet of paper having an image on a surface thereof and stacking the paper sheet, the apparatus comprising:

a paper discharging base upon which discharged sheets are stacked;

blowing means located adjacent said paper discharging base for sending a gas flow to a space between a surface of the paper sheet previously discharged and arranged on said paper discharging base and a rear face of the next discharged paper sheet, wherein the blowing means is integrated with a lower guide roller, a middle guide roller and an upper guide roller as a unit, and wherein said blowing means, the lower guide roller, the middle guide roller and the upper guide roller are fixed to a slider slidably arranged along a guide rail arranged in a vertical direction.

7. A paper discharging apparatus as claimed in claim 6, wherein the paper discharging apparatus further comprises a paper position sensor for detecting the height of printed sheets of paper stacked on said paper discharging base, and means for lowering the paper discharging base by a constant amount based on a detecting signal of the paper position sensor.

8. A paper discharging apparatus as claimed in claim 6, wherein the slider comprises a nut fixed to the slider and screwed onto a screw parallel to the guide rail, said slider being vertically moved along the guide rail by moving the nut in accordance with rotation of the screw by the operation of an elevating motor.

9. A paper discharging apparatus as claimed in claim 6, wherein the blowing means further comprises blowing interruptive means for interrupting a blowing operation of said blowing means when the paper sheet is discharged above said paper discharging base.

10. A paper discharging apparatus as claimed in claim 9, wherein the blowing interruptive means comprises a shutter.

11. A paper discharging apparatus as claimed in claim 10, wherein the shutter is disposed in the vicinity of a blowout port of the blowing means, and is connected to a coil spring fixed to a printer body at one end of the shutter and to a solenoid at the other end of the shutter, said shutter opening and closing the blowout port by turning the solenoid on and off.

12. The paper discharging apparatus of claim 6, further including a transport conveyor for conveying a paper sheet toward said paper discharging base, and wherein said blowing means is located between said transport conveyor and said paper discharging base.

13. A paper discharging apparatus for sequentially discharging a sheet of paper having an image on a surface thereof and stacking the paper sheet, the apparatus comprising:

a paper discharging base upon which discharged sheets are stacked;

blowing means located adjacent said paper discharging base for sending a gas flow to a space between a surface of the paper sheet previously discharged and arranged on said paper discharging base and a rear face of the next discharged paper sheet, wherein the blowing means further comprises a flow adjusting plate for adjusting the air flow, a blowing path formed to surround the flow adjusting plate, a blowing fan arranged at an end of a fan housing forming the blowing path on an air inlet side, and an air inlet port formed at the air inlet side end of the fan housing, and wherein said flow adjusting plate extends substantially parallel to a direction of flow of air along said blowing path, thereby promoting laminar flow of air provided by said blowing means.

14. A paper discharging apparatus for sequentially discharging a sheet of paper having an image on a surface thereof and for stacking the paper sheet comprising:

a plurality of paper discharge trays for receiving paper sheets;

a transport conveyor for selectively transporting a paper sheet to one of said plurality of paper discharging trays, said transport conveyor including an end at which a paper sheet exits said transport conveyor;

a blower for directing a gas flow into a space between a surface of a paper sheet previously discharged onto one of said plurality of discharge trays and a rear face of a next discharged paper sheet as the next discharged paper sheet exits said end of said transport conveyor; and a movable mount upon which said blower and said end of said transport conveyor are mounted, such that said end of said transport conveyor and said blower are movable together for selectively feeding paper sheets to said plurality of paper discharge trays.

15. The paper discharging apparatus of claim 14, wherein said transport conveyor includes at least one roller mounted upon said movable mount.

16. The paper discharging apparatus of claim 14, wherein said transport conveyor includes a lower guide roller, a middle guide roller and an upper guide roller mounted upon said movable mount.

* * * * *